US005721558A

United States Patent [19]

Holemans

[11] Patent Number: 5,721,558

[45] Date of Patent: Feb. 24, 1998

[54] DEPLOYABLE HELICAL ANTENNA

[75] Inventor: Walter Holemans, Washington, D.C.

[73] Assignee: CTA Space Systems, Inc., Rockville, Md.

[21] Appl. No.: 642,454

[22] Filed: May 3, 1996

[51] Int. Cl.[6] ..... H01Q 1/36

[52] U.S. Cl. ..... 343/895; 343/880; 343/DIG. 2

[58] Field of Search ..... 343/880, 895, 343/881, DIG. 2; H01Q 1/36

[56] References Cited

U.S. PATENT DOCUMENTS

| | | | |
|---|---|---|---|
| 3,836,979 | 9/1974 | Kurland et al. | 343/881 |
| 3,906,509 | 9/1975 | DuHamel | 343/895 |
| 3,913,109 | 10/1975 | Owen | 343/880 |
| 4,008,479 | 2/1977 | Smith | 343/895 |
| 4,068,238 | 1/1978 | Acker | 343/895 |
| 4,475,111 | 10/1984 | Gittinger et al. | 343/895 |
| 4,554,554 | 11/1985 | Olesen et al. | 343/895 |
| 4,593,290 | 6/1986 | Wojtowicz | 343/900 |
| 4,725,845 | 2/1988 | Phillips | 343/702 |
| 4,780,727 | 10/1988 | Seal et al. | 343/895 |
| 5,170,176 | 12/1992 | Yasunaga et al. | 343/895 |
| 5,191,352 | 3/1993 | Branson | 343/895 |
| 5,255,005 | 10/1993 | Terret et al. | 343/895 |
| 5,346,300 | 9/1994 | Yamamoto et al. | 343/895 |
| 5,349,365 | 9/1994 | Ow et al. | 343/895 |

*Primary Examiner*—Michael C. Wimer
*Attorney, Agent, or Firm*—Fish & Richardson P.C.

[57] ABSTRACT

The deployable helical antenna of the present invention and helical antenna deployment system includes a helical antenna having a plurality of helical filars and at least two guide plates positioned with respect to the helical filars. Each of the guide plates is provided with a plurality of guide elements operably attached to a corresponding helical filar. The novel helical antenna of the present invention can be collapsed into a stowed position such that each of the helical filars, and portions thereof, are tightly and efficiently layered one over another. Upon actuation of a retention mechanism, the stored energy in each of the collapsed helical filars initiates antenna deployment whereby the guide elements accurately and reliably control the movement and final position of a corresponding helical filar. The novel deployment system of the present invention controls the operational parameters of the antenna (such as diameter, height, and pitch angle), insures quick and reliable antenna deployment, and increases the lateral stiffness of the deployed antenna.

18 Claims, 8 Drawing Sheets

DEPLOYABLE HELICAL ANTENNA

BACKGROUND OF THE INVENTION

The present invention relates generally to antennas. More specifically, the invention is directed to a novel deployable helical antenna incorporating a novel helical antenna deployment system. The novel antenna of the present invention is best suited for use in the context of satellite communications.

In order to comprehend some of the problems which confront aerospace engineers in the deployment of spacecraft components, it is important to understand a few underlying principles. A launch vehicle (e.g., a rocket) which carries a satellite to be placed in orbit undergoes aerodynamic drag and heating while exiting the earth's atmosphere. As such, it is desirable to manufacture the launch vehicle with a minimum cross-sectional area in order to reduce drag and heating effects. Spacecraft (e.g., an orbiting satellite), on the other hand, are preferably manufactured to have maximum cross-sectional area to simplify the layout of instruments and obtain the optimal orientation of deployed spacecraft structures such as antennas and solar panels.

Generally, the result of these contrary goals is that spacecraft are manufactured with relatively small volumes and cross-sectional areas. In order to meet stringent volume and area restrictions placed on spacecraft for launch, designers must densely pack all of the instruments and components (viz. antennas, solar panels, booms, sensors, etc.). Specifically, the instruments are densely packed and arranged within the spacecraft during the flight into orbit.

Once the launch vehicle is separated from the spacecraft and orbit is successfully achieved, the once densely packed spacecraft instruments are deployed. Generally, the spacecraft component is held in its stowed position against the force of a tension or torsion spring by a retention device which restrains the spacecraft component from moving into a deployed position. When it is desired to deploy the spacecraft component, a control signal changes to cause the retention device to release the deployable instrument, allowing it to move into its deployed position. Engineers have been grappling with a fundamental principle in spacecraft deployables for forty years: to concentrate as many devices as possible in the smallest space and have them deploy reliably, predictably, quickly, and accurately for a minimum in weight, volume, and cost. The deployment of a satellite antenna presents many engineering considerations and complications beyond the fundamental concerns noted above.

The operational frequency and associated bandwidth of an antenna are subject to regulation by various governmental agencies including the Federal Communication Commission (FCC). Upon application to the FCC, the FCC will grant a license of operation for a communication satellite only at a given frequency and bandwidth. Operation outside the licensed frequency range is illegal and obviously interferes with the transmissions of other communication satellites operating in the violated frequency ranges.

One type of antenna commonly used in spacecraft applications is the helical antenna having a plurality of thin conductor elements or filars helically coiled about a longitudinal axis of the antenna. The quadrifilar helical antenna (e.g. an antenna having four helical conducting elements) and the bifilar helical antenna (e.g. an antenna having two helical conducting elements), for example, are commonly used for the transmission of electromagnetic waves in spacecraft applications. A helical antenna offers many advantages over other conventional antennas (e.g. the whip antenna, paddle antenna, patch antenna, and parabolic antenna) in a given range of frequency and gain, and propagation direction. These advantages include a reduction in power consumption and improvements in bandwidth control. A helical antenna, like all antennas, must transmit power at a desired frequency and in a proper direction. In this regard, a helical antenna must meet exacting design specifications in its final deployed configuration in order to properly function within its intended range of operation.

As known in the art, the variables for consideration in the design of a helical antenna are its diameter, height, pitch angle, width of the filar elements, and the number of turns in the helix. The accepted industry tolerance is approximately ¼ inch in the antenna diameter and height, and one degree in the helix pitch angle. If the helical antenna should fall outside of these accepted tolerances in its deployed configuration, the result is a considerable loss of performance. First, because the operating frequency, direction, and bandwidth is a factor of the antenna diameter, pitch angle, and height, an unacceptable variation in any of these results in an unacceptably low gain and bandwidth at the intended operating frequency. As discussed above, operational frequencies falling outside those authorized in an FCC license is a violation of FCC regulations. Moreover, the operation of the antenna in the transmission of electromagnetic waves is severely hampered with an unintended diameter, pitch angle, or height. For example, variations in the targeted design factors can easily result in significant decrease in emitted power or an undesired increase in emitted power that may not be permitted in an FCC license.

Because of the deployed dimensional requirements in the configuration of helical antennas, their deployment in spacecraft applications is complex and problematic. The awkward shape and the configuration of the helix conductor elements further complicates the task of constructing and deploying a helical antenna. Aside from avoiding the commercial application of helical antennas in spacecraft altogether, several prior art attempts have been made to design and engineer a helical antenna capable of being deployed from a stowed position while meeting the critical operational specifications noted above.

One such attempt, disclosed in U.S. Pat. No. 3,836,979 to Kurland et al., includes providing a single helical element that is attached to a longitudinally extendible and contractible support structure. Upon release, the support structure and helical element extend into a deployed position. This configuration has several limitations and has not proven successful. First, the disclosed configuration is directed to single filar antenna and not well suited for multiple helix antennas. Moreover, the additional support structure of the disclosed design requires additional payload volume in a launch vehicle and increase total payload weight. At a launch cost of $15,000 to $100,000 per pound (in 1995 dollars) of launch weight, additional weight in spacecraft components can often result in the cancellation of a spacecraft program. Moreover, this prior art configuration does not insure that the diameter and pitch angle of the deployed antenna are within the acceptable tolerances. Similarly, U.S. Pat. No. 4,068,238 to Acker discloses a single filar antenna having the same limitations noted above.

U.S. Pat. No. 4,780,727 to Seal et al. and U.S. Pat. No. 3,913,109 to Owen disclose multi-filar collapsible helical antennas. The disclosed antenna configurations require, however, the use of a boom or mast, and associated support structures, in order to achieve proper deployment. These additional elements are undesirable in spacecraft applications as noted above. Moreover, such structures complicate the deployment process and are sources of potential alignment errors.

The deficiencies and limitations described above are not intended to be exhaustive, but rather are among many which demonstrate that although significant attention has been devoted to the construction of antennas, particularly helical antennas for use in satellite communications, the helical antennas and deployment systems appearing in the past will admit to worthwhile improvement.

OBJECTS AND BRIEF SUMMARY OF THE INVENTION

It is therefore a general object of the invention to provide a novel helical antenna and deployment system which will obviate or minimize deficiencies of the type previously described.

It is a specific object of the invention to provide a novel helical antenna and deployment system which is reliable, predictable, quick, and accurate in the deployment of a helical antenna.

It is another object of the invention to provide a novel helical antenna and deployment system that controls the stowed and deployed parameters of the helical antenna including the antenna diameter, height, and filar pitch angle.

It is still another object of the invention to provide a novel helical antenna and deployment system that can be incorporated into the structure of a variety of different helical antennas having a variety of different electrical parameters.

It is yet another object of the invention to provide a novel helical antenna and deployment system that reduces the volume required to stow a helical antenna and the total weight of the antenna system.

It is another object of the invention to provide a novel helical antenna and deployment system that increases the stiffness of a deployed helical antenna.

It is another object of the invention to provide a novel helical antenna and deployment system that increases the stiffness of a deployed helical antenna.

BRIEF SUMMARY OF A PREFERRED EMBODIMENT OF THE INVENTION

A preferred embodiment of the invention which is intended to accomplish the foregoing objects includes a helical antenna having a plurality of helical filars and at least two guide or support plates positioned with respect to the helical filars. Each of the guide plates is provided with a plurality of guide elements operably attached to a corresponding helical filar. The novel helical antenna of the present invention can be collapsed into a stowed position such that each of the helical filars, and portions thereof, are tightly and efficiently layered one over another. Upon actuation of a retention mechanism, the stored energy in each of the collapsed helical filars initiates antenna deployment while the guide elements accurately and reliably control the movement and final position of a corresponding helical filar. The novel antenna deployment system of the present invention controls the operational parameters of the antenna (such as diameter, height, and pitch angle), insures quick and reliable antenna deployment, and increases the lateral stiffness of the deployed antenna.

DRAWINGS

Other objects and advantages of the present invention will become apparent from the following detailed description of a preferred embodiment thereof taken in conjunction with the accompanying drawings, wherein.

DETAILED DESCRIPTION

Figure 1:
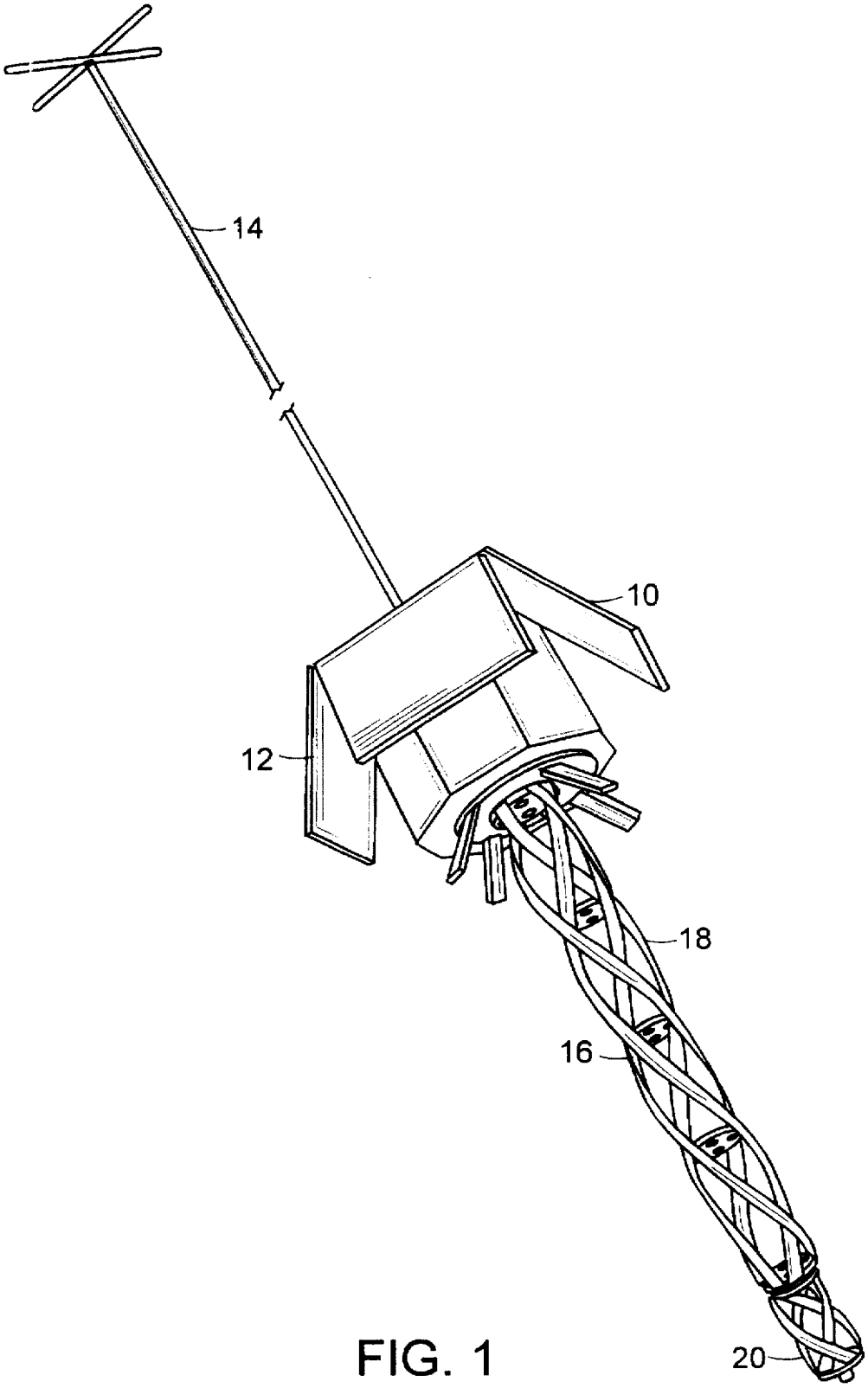
FIG. 1 is a perspective view of a satellite with a deployable, quadrifilar, helical antenna of one embodiment of the present invention.

Referring now to the drawings and particularly to FIG. 1, there is shown a satellite 10 with deployed solar arrays 12, deployed gravity gradient boom 14 and a deployed quadrifilar helical antenna 16 incorporating the novel features of the present invention. The antenna 16 is a combined frequency antenna having a VHF quadrifilar portion 18 and a UHF quadrifilar portion 20. As described above, once the satellite 10 is placed in proper orbit, a respective retention mechanism is activated to permit deployment of the solar arrays 12, gradient boom 14, and antenna 16. A novel hinge for deploying the solar arrays 12 and the gradient boom 14 is disclosed in copending application by Walter Holemans, U.S. application Ser. No. 08/602,207, entitled "Self Latching Hinge."

Figure 2:
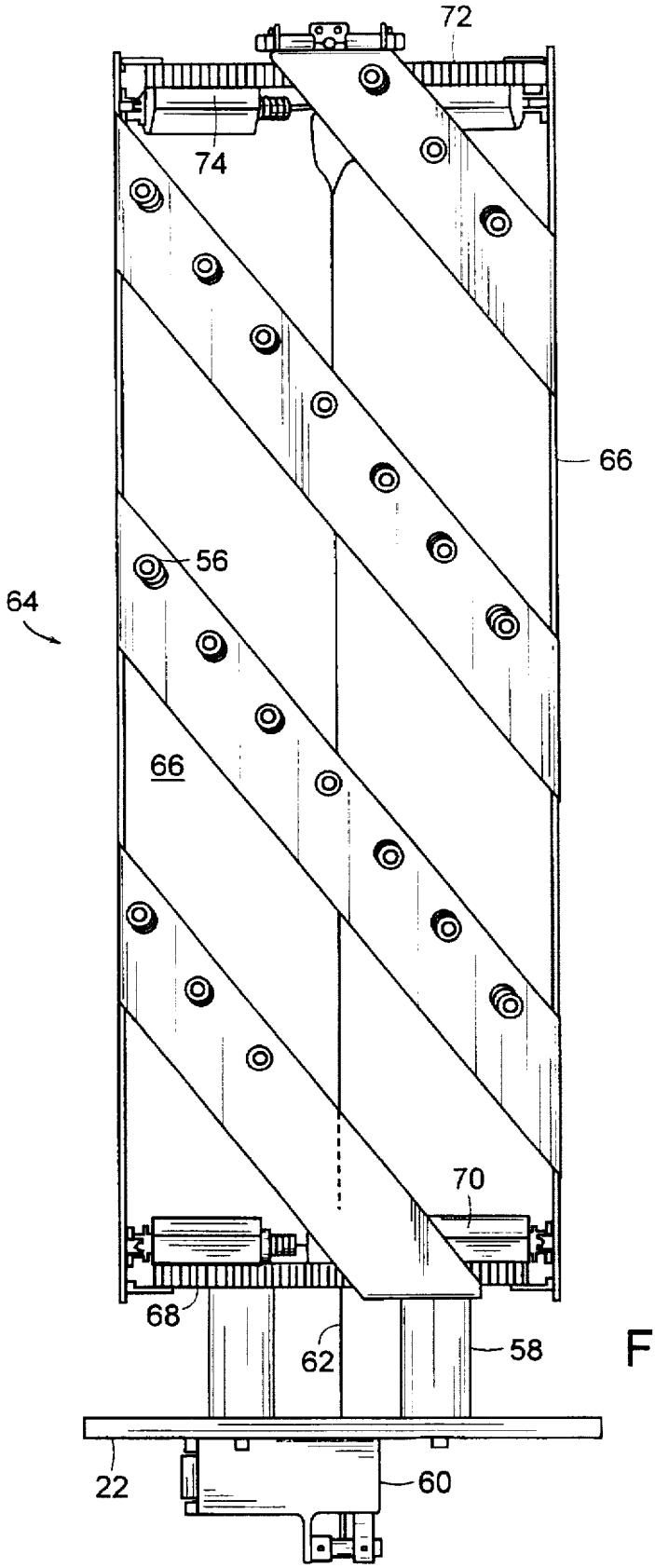
FIG. 2 is a side view of a deployable, quadrifilar, helical antenna in a deployed position of one embodiment of the present invention.
Figure 3:
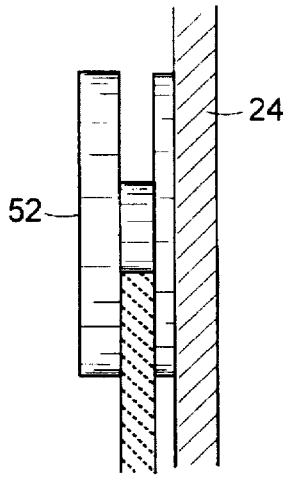
FIG. 3 is a side view of a helical filar with a stand off rivet in a deployable, quadrifilar, helical antenna of the present invention.
Figure 8:
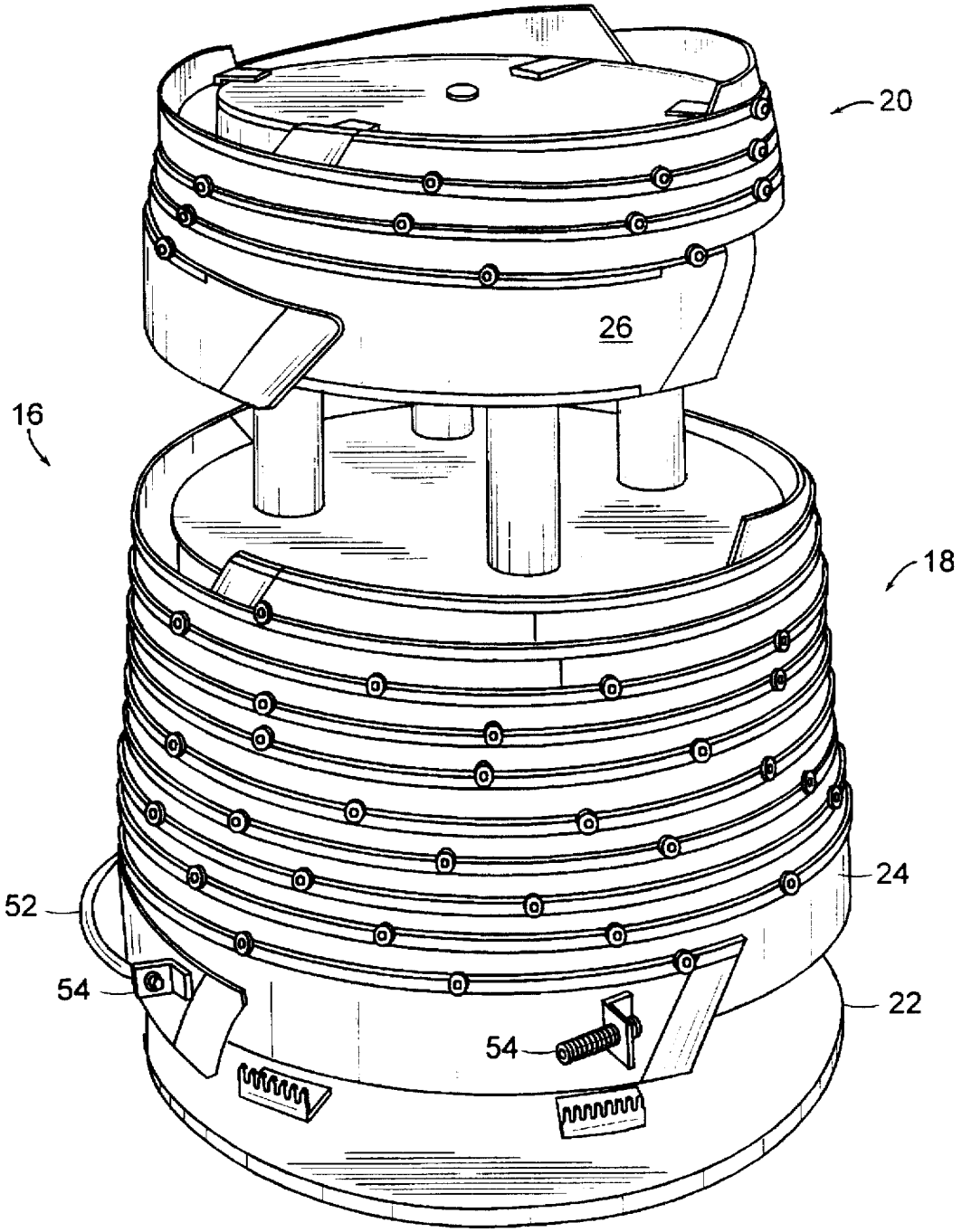
FIG. 8 is an isometric view of a combined high and low frequency deployable, quadrifilar, helical antenna in a stowed position of one embodiment the present invention.
Figure 9:
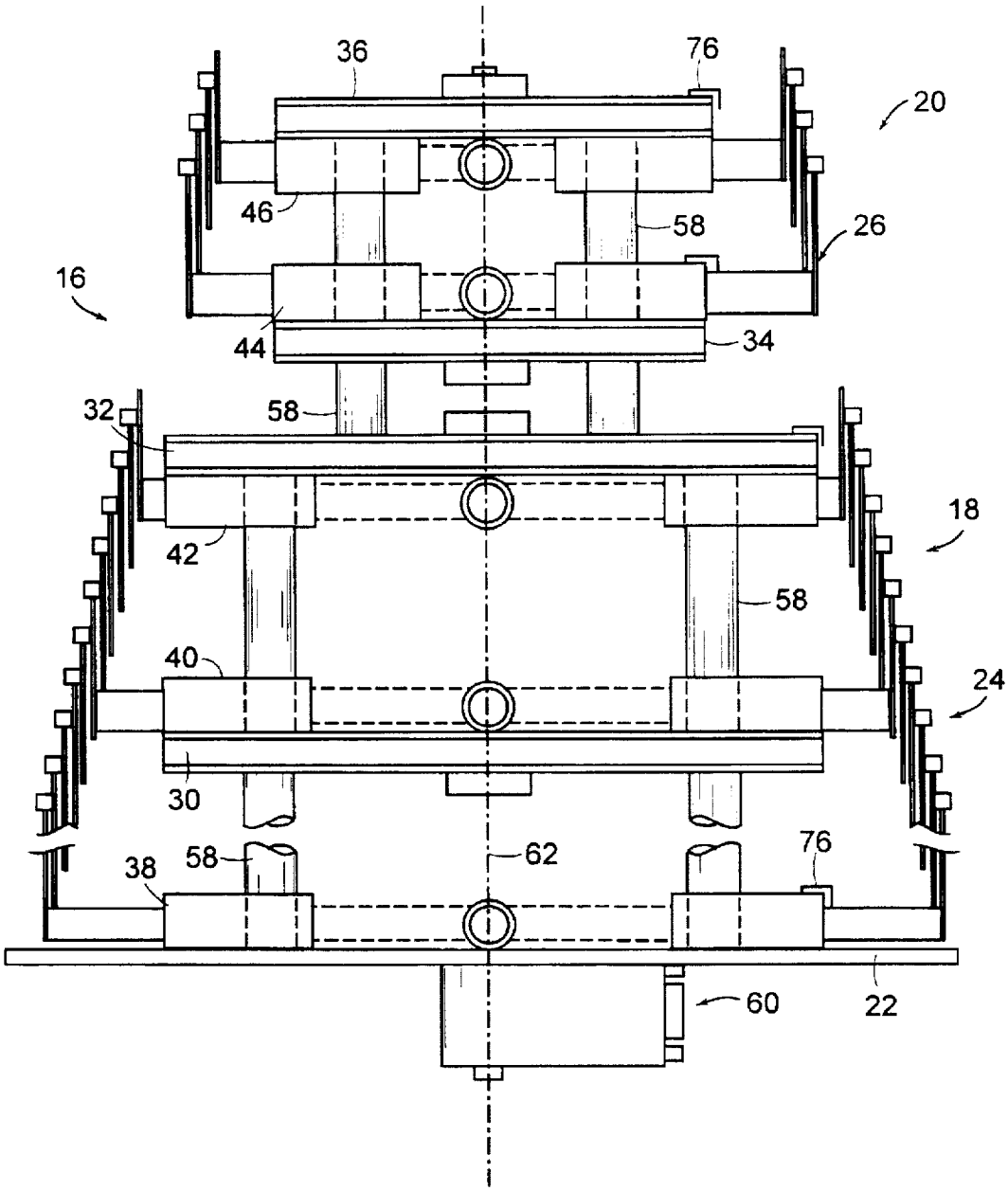
FIG. 9 is a cross-sectional schematic view of a combined high and low frequency deployable, quadrifilar, helical antenna in a stowed position of one embodiment the present invention.

Referring now to FIG. 2, the novel features of the present invention are explained with reference to an embodiment of the present invention showing a novel quadrifilar, helical antenna 64. The antenna 64 is shown in a deployed position and includes a base plate 22 that is mounted to the underside of a satellite 10 body. The antenna 64 is shown in a deployed position with four helical conducting elements or filars 66. In the preferred embodiment, the filars 66 are thin flat elements constructed of a conducting metal such as aluminum or the like. During the construction process, the conductor elements 66 are rolled into a helix having a specified number of turns depending on the electrical parameters of the system. In the embodiment shown in FIG. 2, for example, the conductor elements 66 are rolled to provide a 0.75 or ¾ left hand spiral turn. A series of spacer or stand-off rivets 56, preferably manufactured from an aluminum alloy, are secured along the length of the filars 66. As shown in FIGS. 3, 8, and 9, the stand-off rivets serve to mechanically isolate each of the filars 66 from one another while the antenna is in a stowed position.

A bottom guide plate or support 68 is secured to the base plate or disc 22 by a plurality of support columns 58. The antenna 64 also has an upper guide plate 72. The guide plates or supports 68 and 72 are each preferably constructed from a non-conducting disc 48 (e.g. honeycomb) having corresponding G10 discs 50 on opposing sides (note FIG. 5). The guide plates are further constructed with a copper contact (not shown) that cooperates with a finger 76 to ground each of the filars 66 or provide for other electrical circuitry once the antenna has been deployed. For example, the fingers 66 in cooperation with an electric current source (not shown) could be used as a means to vary the electrical parameters of the antenna 64, as necessary.

The bottom plate includes a plurality of guide elements 70 and the top plate 72 includes a plurality of guide elements 74. The guide elements 70 and 74 can be mounted on either the upper or lower surface of the corresponding guide plates depending on the antenna configuration. Preferably, the guide elements 70 and 74 are constructed of a non-conducting material. The number of guide elements secured to each plate corresponds to the number of filars 66 in the helical antenna. For example, for a quadrifilar helical antenna, there are four guide elements on each respective guide plate. The novel guide plates 68 and 72 and associated guide elements 70 and 74 of the present invention serve to assist in deployment of the antenna 16, provide increased lateral and diametrical stiffness in the deployed antenna, and control the antenna operational and design parameters such as height and pitch angle as hereinafter described.

Figure 4:
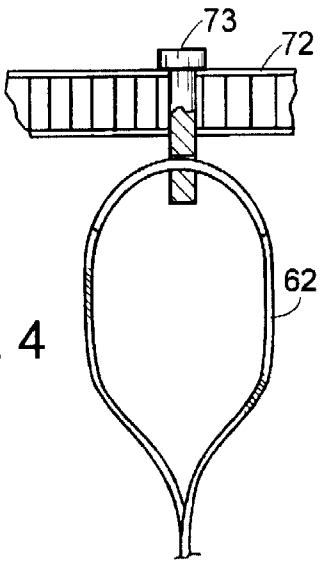
FIG. 4 is a cross-sectional view showing an upper guide plate with retention cord of a deployable, quadrifilar, helical antenna of the present invention.

A retention mechanism 60 is secured to the bottom of base plate 22 and interacts with a cord 62 (shown to be severed in FIG. 2) to retain the antenna in a stowed position during flight. The cord 62 is preferably a non-conductor Kevlar rope or the like. As shown in FIG. 4, one end of the cord 62 is looped through a pin 73 that is secured to the upper guide plate 72. Once the satellite 10 is free from its transport, a signal is activated from a control of the satellite to activate the retention mechanism 60. Activation of a retention mechanism 60 moves a cutter that severs the cord 62, thereby initiating deployment of the antenna 16 as described hereinafter.

Figure 5:
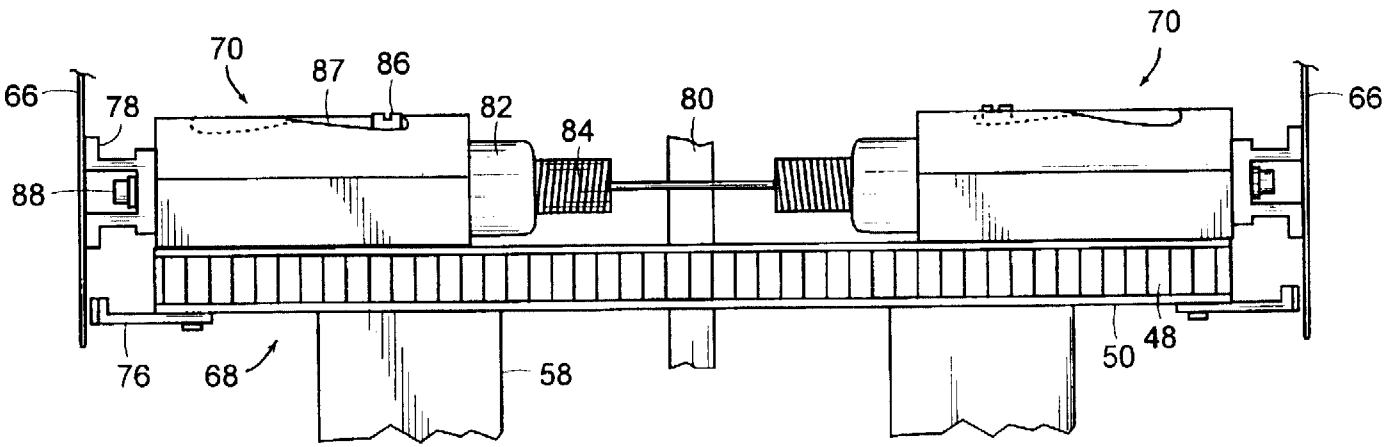
FIG. 5 is a side view of a guide plate having a plurality of guide elements in a deployable, quadrifilar helical, antenna of the present invention.
Figure 6:
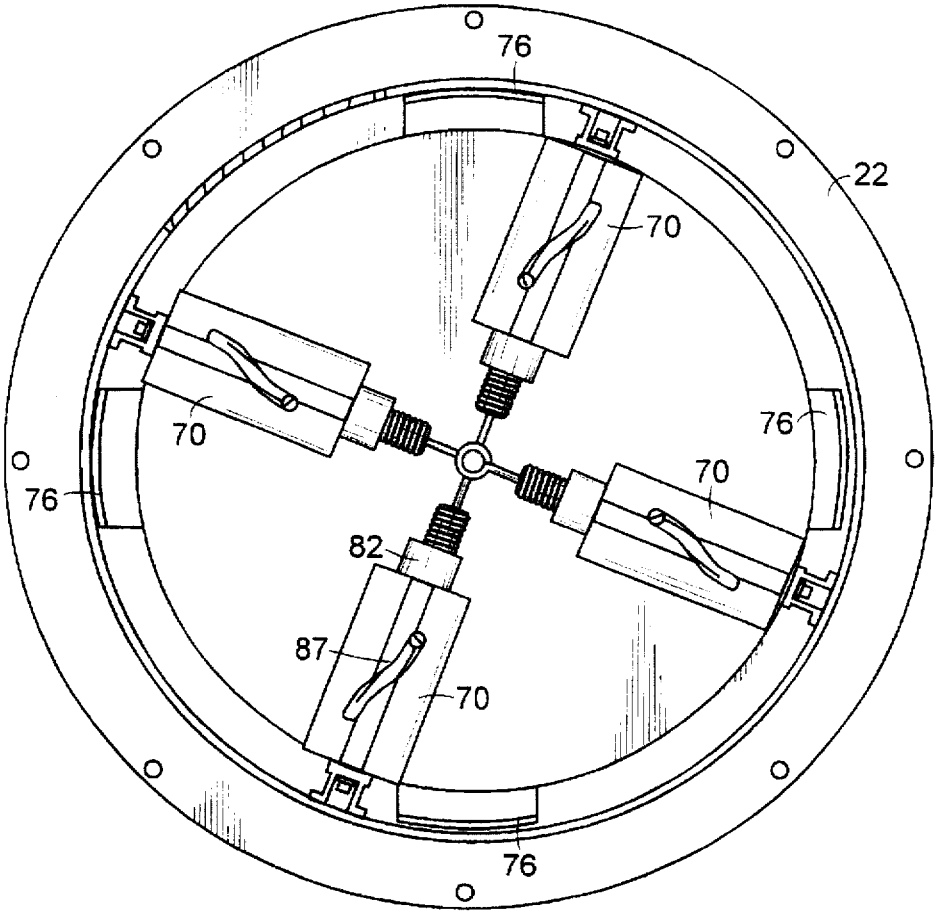
FIG. 6 is a top view of a guide plate having a plurality of guide elements in a deployable, quadrifilar, helical antenna of the present invention.

Referring now to FIGS. 5 and 6, there is shown an elevation and plan view, respectively, of the guide plate 68 with helical guide elements 70. The guide plate 68 is provided with a non-conductor tubular center post 80 through which the retention cord 62 passes. Rods 82 of each of the four guide elements 70 are secured to a respective filar 66 though a bracket 78. The bracket 78 may be attached to a respective filar 66 using an appropriate fastening means such as screws, bolts, or an adhesive. A bolt 88 or the like attaches the bracket 78 to one end of a non-conductor rod 82. Alternatively, the rod 82 could be directly secured to a respective filar 66 using a screw, bolt, or an adhesive thereby dispensing the need for a bracket 78. The rod 82 moves within a bore 90 formed through the guide element 70 between a first antenna stowed position (i.e. substantially removed from the bore 90) to a second antenna deployed position (i.e. substantially received within bore 90). In FIG. 5, the rod 82 is shown in its second received position. At least a portion of the rod is preferably configured with a cylindrical space 85 for receiving a second end of a tension spring 84. A first end of a tension spring 84 is operably attached to the tubular center post 80 and a second end of the tension spring is operably attached to a guide pin 86. The body of the guide element 70 and the rod 82 are preferably manufactured from a non-conductor G-10 composite or the like. The guide pin 86 is preferably constructed from a steel alloy or the like.

Figure 7:
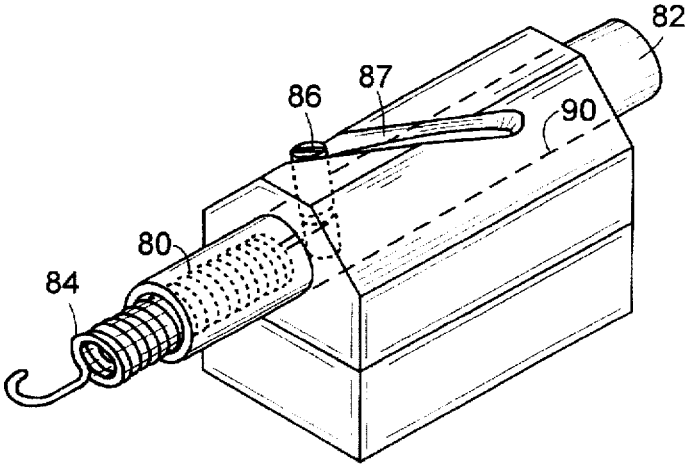
FIG. 7 is an isometric view of a guide element of a helical antenna deployment system of the present invention.

The guide pin 86 cooperates with a helical groove 87 formed in the body of the guide element 70. The specific configuration and dimensions of the groove 87 depend on the stowed and deployment parameters of the helical antenna. Each plate 68 and 72 has a set of guide elements of predefined radial and a predefined angular dimension such that the respective pins 86 radially and angularly translate within the respective grooves 87 from a first outer radial position (i.e. antenna stowed) to a second inner radial position (i.e. antenna deployed). Referring to FIG. 7, the guide pin 86 is secured through a transverse bore (for example, by screwing the pin into the bore) formed through rod 82 at the hollow portion 85. A detent formed on the circumference of the pin receives a loop of the spring 84 within the hollow portion 85 of the rod 82. The guide elements 70, including respective grooves 87, on the guide plate 68 are all identical in configuration. Similarly, the guide elements 74, including respective grooves 87, of the guide plate 72 are identical in configuration.

The grooves 87 of each of the guide elements 38 are configured to guide and accurately align the respective helical filars 66 in both the stowed and deployed position. Specifically, as the spring 84 pulls on the pin 86, the pin 86 translates radially within the groove 87 and simultaneously rotates within the groove 87. The radial and angular movements of the pin 86 are followed by the rod 82 because of its attachment to the pin 86. Similarly, radial and angular movements of the rod 82 are followed by the respective helical element or filar 66 because of its attachment to the rod 82.

In the stowed position (note FIGS. 8 and 9 below), the tension springs 84 provide a pulling force on pin 86, in turn on rod 82, and in turn on the respective helical filar 66. The helical filars 66, however, remain in a layered and compact configuration because the cord 62 of the retention mechanism 60 prevents the stored energy in the filars 24 and tension springs 84 from releasing the antenna. Once the retention mechanism 60 severs the cord 62, the stored forces in the filars release and cause the pins 86 to travel within respective grooves 87, as described above, from their outer radial position to their inner radial position.

Referring now to FIGS. 8 and 9, the novel features of the present invention are further demonstrated with reference to a combined VHF and UHF antenna 16 shown in a stowed or in-flight position where like numerals indicate like parts. The quadrifilar helical antenna 16 of this embodiment has four conductor elements or filars 24 (VHF) and filars 26 (UHF). As above, the conductor elements 24 and 26 are thin flat elements constructed of a conducting material having a high specific stiffness, such as aluminum or the like. For manufacture, the conductor elements 24 and 26 are rolled into a helix having a specified number of deployed turns. Similar to the antenna 64 of FIG. 2, the antenna 16 further includes conducting wires 52, for transmitting power through the antenna, that are positioned about the filars and secured by brackets 54. The UHF and VHF portions of the antenna are separated by support columns 58, respectively attached at both ends to guide plates 32 and 34. A retention mechanism 60 is secured to the bottom of support disc 22 and interacts with a cord 62 to retain the antenna in a stowed position during flight. In the alternative embodiment, the deployment system includes a series of guide plates 28, 30, 32, 34, and 36. As indicated by the broken line in FIG. 9, however, it is to be understood that any number of guide or support plates could be used depending on the height of the height of the antenna. The guide plates 28, 30, and 32 of the VHF antenna 18 have the same diameter and the guide plates 34 and 36 of the UHF antenna 20 both have the same diameter as shown in FIG. 9. Mounted on the guide plates are respective helical guide elements 38, 40, 42, 44, 46. The guide elements 38, 40, 42, 44, and 46 can be mounted on the upper or lower surface of the corresponding guide plates depending on the appropriate antenna configuration. Each of the plates of the VHF antenna 18 are separated by support columns or tubes 58 as shown, preferably manufactured from G10 material. The support tubes 58 are attached only at one end to a guide plate. The tubes 58 serve to prevent the plates from abutting the guide elements when the satellite is in a stowed position.

Figure 10:
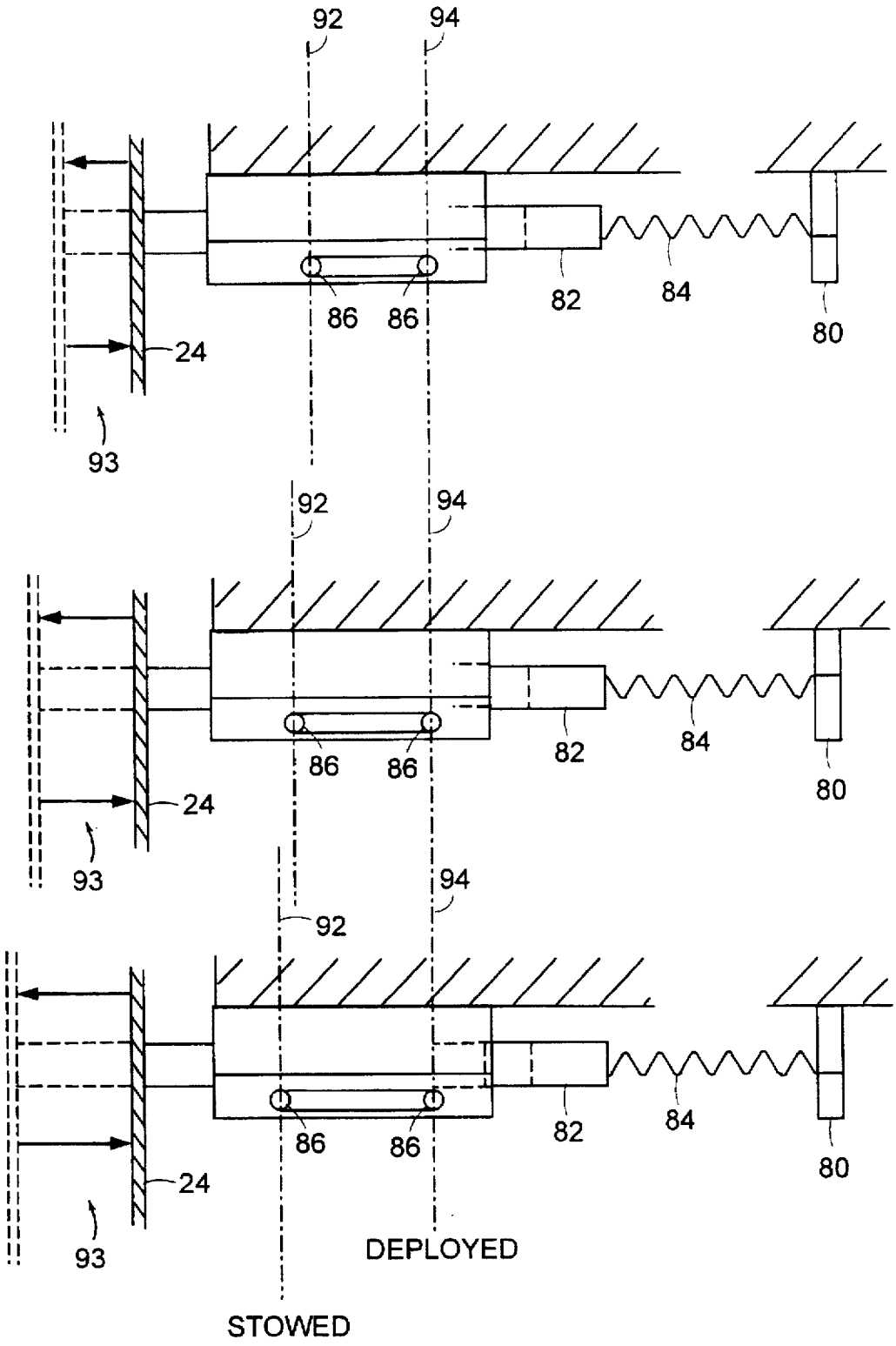
FIG. 10 is a schematic of a guide element and corresponding helical filar of the present invention moving from an antenna stowed position to an antenna deployed position.

Referring to FIG. 10, there is shown schematically the progression of the pins 86 of, for example, the guide elements 38, 40, and 42 of the present invention, as the antenna moves from its stowed to its final deployed position. It is to be understood that the grooves formed in the guide elements are helical grooves and FIG. 10 is only a schematic representation. As shown, the outer radial end 92 of the grooves 87 have different radial dimension; the groove 87 of the lower most guide element (for example, guide element 38 of FIG. 9) has the greatest outer radial dimension 92 and the groove 87 of the upper most guide element (for example, guide element 42 of FIG. 9) has the least outer radial dimension 92 for the VHF antenna 18. More generally, guide elements secured to the bottom plates (e.g. plate 28 for the VHF, plate 34 for the UHF, plate 68 for the configuration of FIG. 2) of the antenna incorporating the novel deployment system have guide grooves 87 with the greatest outer radial dimension 92 and guide elements secured to the upper plates (e.g. plate 32 for the VHF, plate 36 for the UHF, and plate 72 for the configuration of FIG. 2) have guide grooves 87 with the smallest outer radial dimension 92. Any guide plates in between have guide grooves 87 with intermediate outer radial dimensions 92. With this novel configuration, the helical filars 24 can be compacted and neatly layered one over another in the stowed position. As shown in FIGS. 8, 9, and 10, because the guide grooves 87 of the guide elements secured to the bottom plate 28 or 68 have a larger outer radial dimension 92, more radial space 93 is created at the lower portion of the antenna to accept the layered helical filars.

Once the cord 62 is severed, the spring forces of the tension spring 84 and the filars 24, cause the pins 86 to radially translate within respective groove 87. As it radially translates, the pin 86 will rotate within groove 87 causing a corresponding shift to the rod 82, and therefore to the corresponding filar 24. The pins 86 will translate until each abuts an inner most radial wall of the grove 87 corresponding to an inner most radial position 94 of the groove 87. All of the grooves 87 of the guide elements in the antenna preferably have the same inner most radial position 94. This position 94 defines the final diameter of the helical antenna such that each filar 24 is radially positioned the same distance in the respective portions of the antenna (e.g. UHF and VHF).

Figure 11:
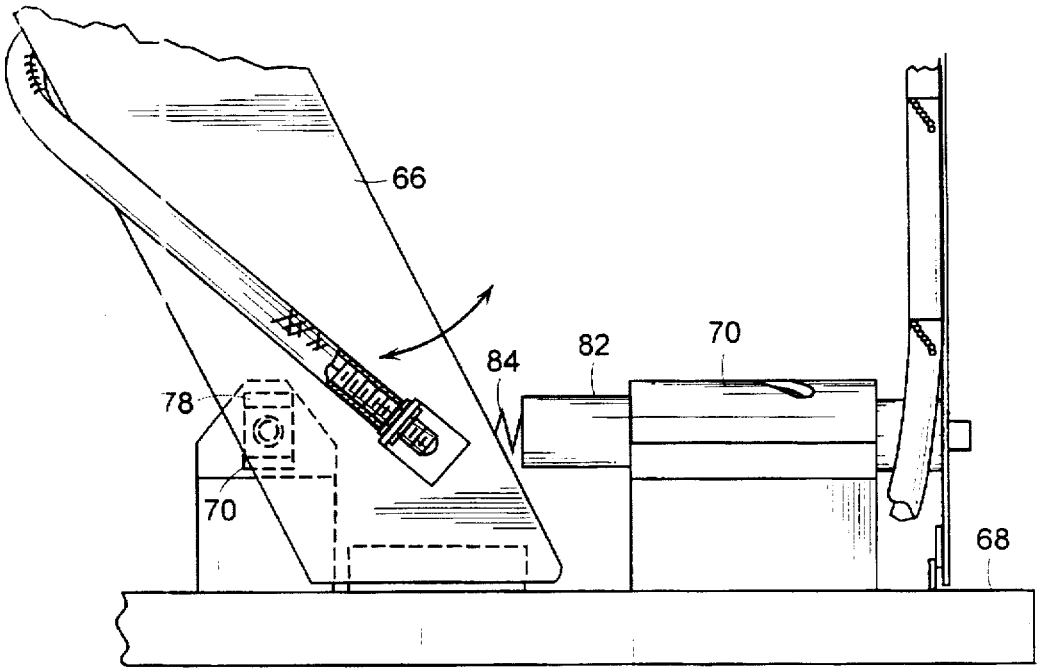
FIG. 11 is a side view of a bottom guide plate showing a helical guide element and corresponding helical filar of a deployable, helical antenna of the present invention.
Figure 12:
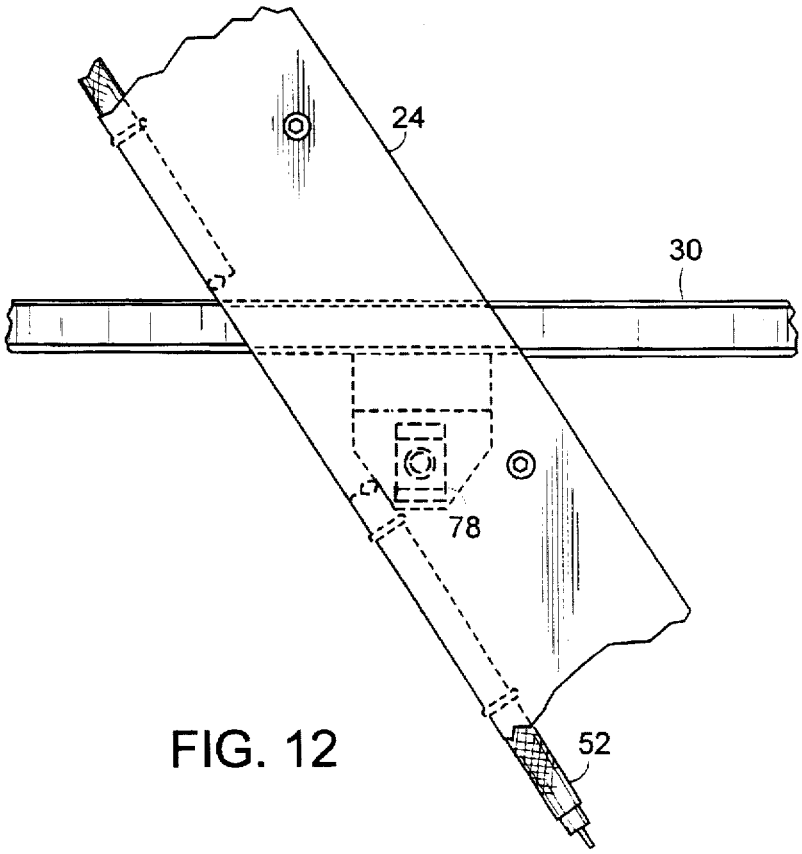
FIG. 12 is a side view of an intermediate guide plate showing a helical guide element and corresponding filar of a deployable, helical antenna of the present invention.

Referring now to FIG. 11, there is shown a side view of a portion of the bottom plate 68 with guide elements 70 having rods 82 secured to a respective filar 66. Similarly, FIG. 12 shows an intermediate plate 30 (note FIG. 9) with a rod 82 of a guide element 40 secured to a filar 24. The filars 24 are provided with an electrical conductor 52 as shown. The antennas depicted in both FIGS. 11 and 12 are in a deployed position. FIGS. 11 and 12 demonstrate how the novel guide elements of the present invention not only control the antenna diameter in the stowed and deployed position, but also control the pitch of the helical filars 24 or 66, which in turn, controls the height of the antenna and the number of turns in the helical filars. The annular position of the rod 82 directly corresponds to the pitch of the filars 24 or 66. As described above, the annular position of the rod 82 is controlled by the configuration of the groove 87. The particular angular dimension of the grooves 87 depends on the number of filars in the antenna and the antenna parameters (e.g. height, diameter, and pitch).

EXAMPLE

The invention will now be described in terms of an example that is provided in order to better elaborate and describe the invention and in no way should be understood to limit the scope thereof. In the exemplary embodiment, the VHF antenna 18 is constructed with the following dimensional specifications:

deployed diameter=8.83 inches helix turn=1.29 left hand turn for each filar 24 deployed height=68.94 inches filar thickness=0.032 inches filar width=1.60 inches Similarly, the UHF antenna 20 is constructed with the following dimensional specifications:

deployed diameter=6.825 inches helix turn=0.75 left hand turn for each filar 26 deployed height=19.90 inches filar thickness=0.025 inches filar width=1.60 inches.

In the exemplary embodiment, the guide elements of the VHF and UHF antennas are constructed with the following dimensional specifications:

(1) guide elements 38 are mounted on guide plate 28, 0.875 inches above base plate 22 and the radial (between line 92 and 94 in FIG. 10) and angular dimension of groove 87 is 0.822 inches and 57.03 degrees, respectively.

(2) guide elements 40 are mounted on guide plate 30, 34.668 inches above base plate 22 and the radial (between line 92 and 94 in FIG. 10) and angular dimension of groove 87 is 0.528 inches and 57.03 degrees, respectively.

(3) guide elements 42 are mounted on guide plate 32, 68.460 inches above base plate 22 and the radial (between line 92 and 94 in FIG. 10) and angular dimension of groove 87 is 0.234 inches and 57.03 degrees, respectively.

(4) guide elements 44 are mounted on guide plate 34, 0.619 inches above base plate 34 and the radial and angular dimension of groove 87 is 0.773 inches and 45.52 degrees, respectively.

(5) guide elements 46 are mounted on guide plate 36, 19.440 inches above base plate 36 and the radial and angular dimension of groove 87 is 0.546 inches and 45.52 degrees, respectively.

Given these parameters, the VHF antenna 18 can be collapsed to a total height of 7.50 inches and a maximum diameter of 10.47 inches. Similarly, the UHF antenna 20 can be collapsed to a total height of 3.85 inches and a maximum diameter of 8.37 inches. The foregoing specifications are provided merely to set forth a working example of the combined UHF/VHF antenna of the present invention. It is to be understood, however, that the provided dimensional specifications in no way limit the intended scope of the invention and the particular size and dimension of the recited components depends on the particular application of the present invention.

SUMMARY OF MAJOR ADVANTAGES OF THE INVENTION

After reading and understanding the foregoing detailed description of an inventive deployable helical antenna and helical antenna deployment system in accordance with preferred embodiments of the invention, it will be appreciated that several distinct advantages of the subject deployable helical antenna and helical antenna deployment system are obtained.

Without attempting to set forth all of the desirable features of the instant deployable helical antenna and helical antenna deployment system, at least some of the major advantages include a helical antenna 16 or 64 having a plurality of helical filars 24 or 66. At least two guide plates 68 and 72 are provided and positioned with respect to the helical filars 24 or 66. A plurality of guide elements 70 and 74 are secured on a corresponding guide plate 68 and 72 and are operably attached to a corresponding helical filar 24 or 66. Each of the guide elements 70 and 74 comprises a rod 82 positioned within a bore 90 of the guide element that is movable between a first position removed from the bore 90 (i.e. antenna stowed position) to a second position received with the bore 90 (i.e. antenna deployed position). The guide elements 70 and 74 further include a guide groove 87 having a predetermined radial and angular dimension and a pin 86 that is operably connected to the rod 82. The pin 86 is movable within the groove 87 between an outer radial position 92 and an inner radial position 94 such that during an antenna deployment phase, the pin 86 radially translates and angularly rotates as it moves from its outer radial position 92 to its inner radial position 94. Radial and angular movement of the pin 86 is followed by the rod 82 which in turn is followed by an attached helical filar 24 or 66.

The groove 87 of each of the guide elements is calculated and constructed to correspond to the proper antenna diameter and filar pitch angle. In this way, the final deployment position of the novel helical antenna of the present invention is accurate and the antenna operational parameters are within design and licensed specification.

In describing the invention, reference has been made to a preferred embodiment and illustrative advantages of the invention. Those skilled in the art, however, and familiar with the instant disclosure of the subject invention, may recognize additions, deletions, modifications, substitutions and other changes which fall within the purview of the subject invention.

What is claimed:

1. A helical antenna configured to move between a stowed position and a deployed position comprising:

at least one helical filar having a length and first and second ends;

at least a first and second support plate positioned with respect to said at least one helical filar at a respective location along the length of said filar; and at least one guide element having a fixed portion connected to said at least first support plate and at least another guide element having a fixed portion connected to said at least second support plate, each of said guide elements having a movable portion configured to rotate and configured to translate in a radial direction with respect to a central axis of the antenna between a first position and a second position, said movable portion being connected to said at least one filar at a respective location along the length of said filar, whereby, when said helical antenna is in its stowed position, said at least first and second support plates are collapsed with respect to one another, and, when said helical antenna moves to the deployed position, each of said movable portions of said guide elements rotates and translates from said first position to said second position such that said at least one helical filar connected to each of said movable portions follows the movement of each of said movable portions and said at least first and second support plates move with respect to one another.

2. A helical antenna as defined in claim 1 wherein each of said at least one guide elements comprise:

a body portion having a first and second end and a bore extending through the body portion from said first to said second end;

said portion movable between a first position and a second position being a rod member operable to move within said bore, said rod operably secured at one end to said at least one filar at said respective location along the length of said filar;

a groove formed along at least a portion of said body portion, said groove having a length and an angular dimension; and a pin operably connected to said rod and operable to move within and along said groove such that as said rod moves from its first position to its second position, said pin is operable to translate along the length of the groove and rotate an amount of the angular dimension of the groove.

3. A helical antenna as defined in claim 2 further comprising:

a post positioned at a central portion of at least one of said support plates; and a spring operably connected at one of its ends to said pin and operably connected at its other end to said post.

4. A helical antenna as defined in claim 1 further comprising:

at least one electrical contact element operably secured to each of said plates, such that when said antenna is in a deployed position, said at least one filar is in contact with said at least one electrical contact.

5. A helical antenna as defined in claim 1 further comprising:

a plurality of rivets secured to said at least one filar along its length such that when said antenna is in a stowed position, said rivets mechanically isolate adjacent portions of said at least one filar from each other.

6. A helical antenna as defined in claim 1 wherein:

there are four helical filars and four corresponding guide elements secured to said at least first and second support plates.

7. A helical antenna as defined in claim 1 further comprising: a bracket for connecting an end of said movable portion and said at least one filar.

8. A helical antenna configured to move between a stowed position having a respective stowed diameter and height and a deployed position having a respective deployed diameter and height comprising:

a plurality of helical filars having a length and first and second ends and a stowed and deployed pitch angle;

a plurality of support plates positioned with respect to said plurality of helical filars at respective locations along the length of said filars such that one of said plurality of support plates is positioned adjacent the first end of said plurality of helical filars and another of said plurality of support plates is positioned adjacent the second end of said plurality of helical filars; and a plurality of guide elements, each having a fixed portion connected to each of said plurality of support plates, said plurality of guide elements corresponding in number to said plurality of helical filars, each of said guide elements having a movable portion configured to rotate and to translate in a radial direction with respect to a central axis of the antenna between a first position and a second position, said movable portion being connected to one of said plurality of filars at a respective location along the length of said filar, whereby, when said helical antenna is in its stowed position, said plurality of support plates are collapsed with respect to one another, and, when said helical antenna moves to the deployed position, each of said movable portions of said guide elements rotates and translates from said first position to said second position such that said plurality of helical filars connected to each of said movable portions follows the movement of each of said movable portions and said plurality of support plates move with respect to one another.

9. A helical antenna as defined in claim 8 wherein each of said plurality of guide elements comprise:

a body portion having a first and second end and a bore extending through the body portion from said first to said second end;

said portion movable between a first position and a second position being a rod member operable to translate and rotate within said bore, said rod operably secured at one end to one of said plurality of filars at said respective location along the length of said one filar;

a groove formed along at least a portion of said body portion, said groove having a length extending from a first radial position to a second radial position and an angular dimension such that the groove of said plurality of guide elements secured to said one plate has a greater length than the groove of said plurality of guide elements secured to said another plate; and a pin operably connected to said rod and operable to move within and along said groove such that as said rod moves from its first position to its second position, said pin is operable to translate along the length of the groove and rotate an amount of the angular dimension of the groove.

10. A helical antenna as defined in claim 9 wherein:

said first radial position of each of said grooves are aligned with one another so as to define said deployed diameter of said antenna and the respective angular dimension of said grooves are configured along the length of said groove to correspond to the stowed and deployed pitch of said antenna filars.

11. A helical antenna as defined in claim 8 wherein:

said one of said plurality of support plates positioned adjacent the first end of said plurality of helical filars is a base plate having means for securing said base plate to a structure.

12. A helical antenna as defined in claim 11 wherein:

said structure is a body of a satellite.

13. A helical antenna as defined in claim 11 further comprising:

a retention mechanism having an associated retention cord secured to said base plate, said retention cord operable to extend from said retention mechanism to said another of said plurality of support plates positioned at the second end of said plurality of helical filars when said antenna is in its stowed position.

14. A satellite having a body and a helical antenna secured to said body, said helical antenna configured to move between a stowed position having a respective stowed diameter and height and a deployed position having a respective deployed diameter and height comprising:

a plurality of helical filars having a length and first and second ends and a stowed and deployed pitch angle;

a plurality of support plates positioned with respect to said plurality of helical filars at respective locations along the length of said filars such that one of said plurality of support plates is positioned adjacent the first end of said plurality of helical filars and another of said plurality of support plates is positioned adjacent the second end of said plurality of helical filars; and a plurality of guide elements, each having a fixed portion connected to each of said plurality of support plates, said plurality of guide elements corresponding in number to said plurality of helical filars, each of said guide elements having a movable portion configured to rotate and to translate in a radial direction with respect to a central axis of the antenna between a first position and a second position, said portion being connected to one of said plurality of filars at a respective location along the length of said filar, whereby, when said helical antenna is in its stowed position, said plurality of support plates are collapsed with respect to one another, and, when said helical antenna moves to the deployed position, each of said movable portions of said guide elements rotates and translates from said first position to said second position such that said plurality of helical filars connected to each of said movable portions follows the movement of each of said movable portions and said plurality of support plates move with respect to one another.

15. A satellite as defined in claim 14 wherein said antenna has a VHF portion and a UHF portion operably attached to one another to form an integral antenna, whereby said VHF portion is provided with a first plurality of helical filars and corresponding first plurality of support plates and guide elements and the UHF portion is provided with a second plurality of helical filars and corresponding second plurality of support plates and guide elements.

16. A satellite as defined in claim 15 further comprising a base plate having means for securing said base plate to said body of the satellite, said base plate operably secured to one of said plurality of support plates of said VHF portion of the antenna.

17. A satellite as defined in claim 16 wherein said base plate is provided with a plurality of guide elements such that said base plate is said one of said plurality of support plates positioned adjacent the first end of said plurality of helical filars.

18. A satellite as defined in claim 15 wherein said first plurality of helical filars of said VHF portion comprises four filars and said second plurality of said helical filars of said UHF portion comprises four filars so as to form an integral quadrifilar helical antenna.

* * * * *